US005655345A

United States Patent [19]

Thompson

[11] Patent Number: 5,655,345

[45] Date of Patent: Aug. 12, 1997

[54] CURVED WALL GLASS BLOCK ASSEMBLY

[76] Inventor: Earl G. Thompson, 2464 NE. 3rd Loop, Camas, Wash. 98607

[21] Appl. No.: 529,478

[22] Filed: Sep. 18, 1995

[51] Int. Cl.[6] ..... E04C 1/42; E04B 2/00

[52] U.S. Cl. ..... 52/396.1; 52/249; 52/306; 52/308; 52/568; 52/717.03; 52/745.1; 52/747.1

[58] Field of Search ..... 52/245–249, 306–308, 52/395, 396.04, 396.05, 396.08, 396.09, 396.1, 47, 562, 565, 568, 717.03, 731.3, 732.2, 745.1, 747.1, 747.12, 731.7, 108, 476

[56] References Cited

U.S. PATENT DOCUMENTS

| | | | |
|---|---|---|---|
| 692,894 | 2/1902 | McQueen | 52/248 |
| 726,639 | 4/1903 | Christensen | 52/248 X |
| 732,102 | 6/1903 | Moulton et al. | 52/248 |
| 1,038,467 | 9/1912 | Westendorf | 52/248 X |
| 1,167,624 | 1/1916 | Chamberlain | 52/248 |
| 2,141,000 | 12/1938 | Hohl | 72/42 |
| 2,239,537 | 4/1941 | Owen | 72/42 |
| 2,708,016 | 5/1955 | Penton | 52/396.04 |
| 3,234,699 | 2/1966 | Smith | 52/173 |
| 3,508,369 | 4/1970 | Tennison | 52/396.08 |
| 3,636,690 | 1/1972 | White | 52/731.7 X |
| 3,729,889 | 5/1973 | Baruzzini | 52/396.04 X |
| 4,055,922 | 11/1977 | Ellington | 52/245 X |
| 4,769,961 | 9/1988 | Gillet | 52/245 |
| 4,774,793 | 10/1988 | Mayer | 52/308 |
| 4,835,921 | 6/1989 | Baggett, Jr. et al. | 52/733.4 X |
| 4,986,048 | 1/1991 | McMarlin | 52/308 X |
| 5,010,704 | 4/1991 | Thompson | 52/308 |
| 5,031,372 | 7/1991 | McCluer | 52/308 X |
| 5,430,985 | 7/1995 | Coleman | 52/308 |
| 5,448,864 | 9/1995 | Rosamond | 52/308 X |

OTHER PUBLICATIONS

PC Glass Block, Windows.Walls.Partitions, for New Homes & Remodeling, 6 pages.

*Primary Examiner*—Robert Canfield
*Attorney, Agent, or Firm*—Henderson & Sturm

[57] ABSTRACT

A method and apparatus for forming a curved wall glass block assembly (100) by stacking vertical tiers (102) (103) (104) etc. of horizontal rows of individual glass blocks (101) on top of a plurality of successive tier base support units (10) comprising a plurality of tie members (20) operatively connected to at least one curved track member (40); wherein each tie member (20) is dimensioned to support one of the individual glass blocks (101).

18 Claims, 3 Drawing Sheets

CURVED WALL GLASS BLOCK ASSEMBLY

TECHNICAL FIELD

The present invention relates to the field of structured wall members or assemblies in general, and in particular to an assembly for joining glass blocks into a curved wall construction.

BACKGROUND ART

This invention is an improvement over U.S. Pat. No. 5,010,704 which issued on Apr. 30, 1991 and is entitled "Glass Block Construction Assembly".

As can be seen by reference to the following U.S. Pat. Nos. 4,774,793; 3,234,699; 2,141,000; and 2,239,537; the prior art is replete with myriad and diverse structural assembly techniques for glass block walls or panels.

While all of the aforementioned prior art constructions are more than adequate for the basic purpose and function for which they have been specifically designed, unfortunately these prior art assembly techniques are uniformly deficient with regard to their ability to fabricate a glass block wall having a curved or arcuate configuration.

While U.S. Pat. No. 5,010,704 is considered to be a superior glass block construction assembly even this fairly recent patent employs elongated generally rigid structural components that do not readily lend themselves to forming an arcuate base upon which to build a curved glass block wall or panel in the absence of the teachings of the present invention.

Given the growing popularity of contoured glass block wall assemblies in modern architecture, it is rather surprising that to date no one has developed a new approach to constructing curved glass block walls or panels that can conform to any desired configuration and which can accurately be reproduced any number of times for large scale projects, or the like.

As a consequence of the foregoing situation, there has existed a longstanding need for a new type of glass block assembly which is quick, simple to use, and inexpensive, which will produce curved glass block walls or panels; and the provision of such a construction is a stated objective of the present invention.

DISCLOSURE OF THE INVENTION

Briefly stated, the curved wall glass block assembly that forms the basis of the present invention comprises one or more track members and a plurality of tie members which cooperate with one another to produce a series of curved base tier support units for consecutive vertical rows of glass blocks to produce a finished, arcuately contoured glass block wall or panel assembly.

As will be explained in greater detail further on in the specification, this invention borrows heavily from the basic teachings contained in U.S. Pat. No. 5,010,704, in that a primary component of this invention is a segmented version of a major component of the former, which has been further modified to receive one or more of the track members employed in the base tier support unit upon which rests each vertical tier of glass blocks which are aligned in an arcuate configuration.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
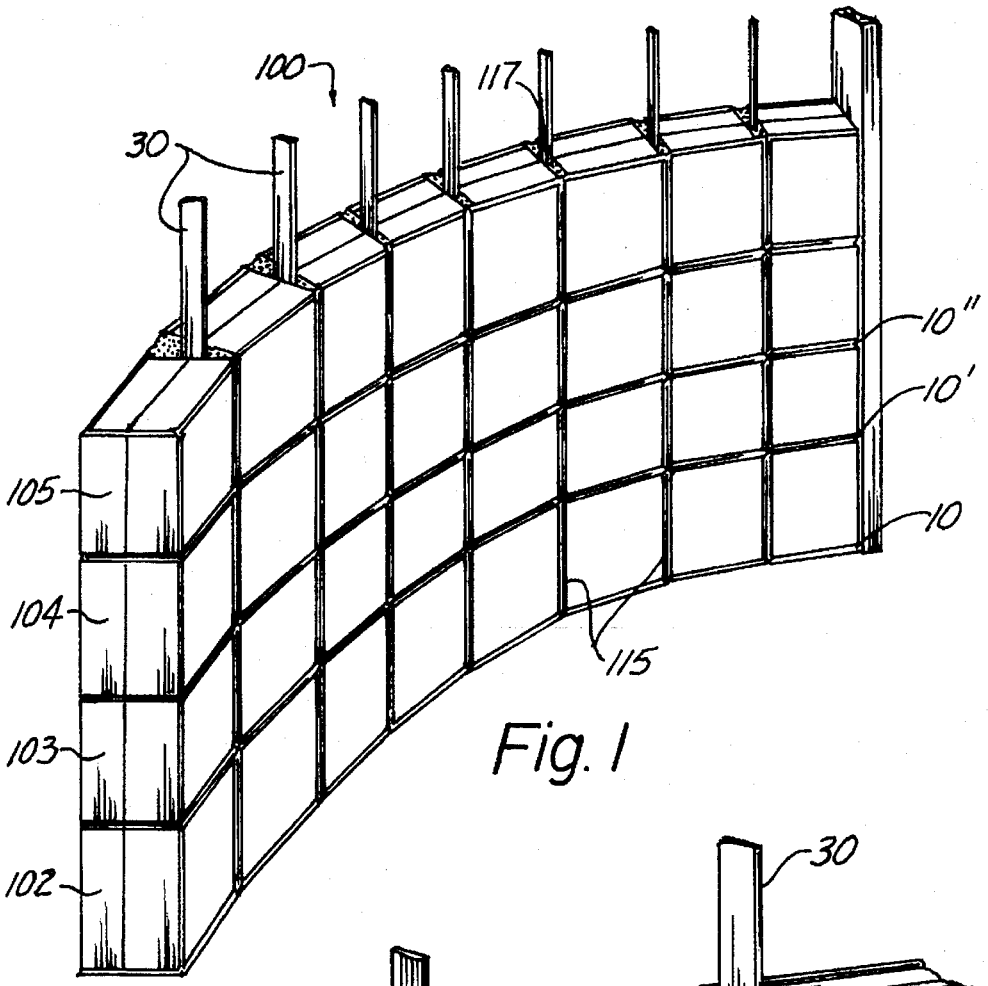
FIG. 1 is a perspective view of a curved wall block assembly constructed in accordance with the teachings of this invention.
Figure 2:
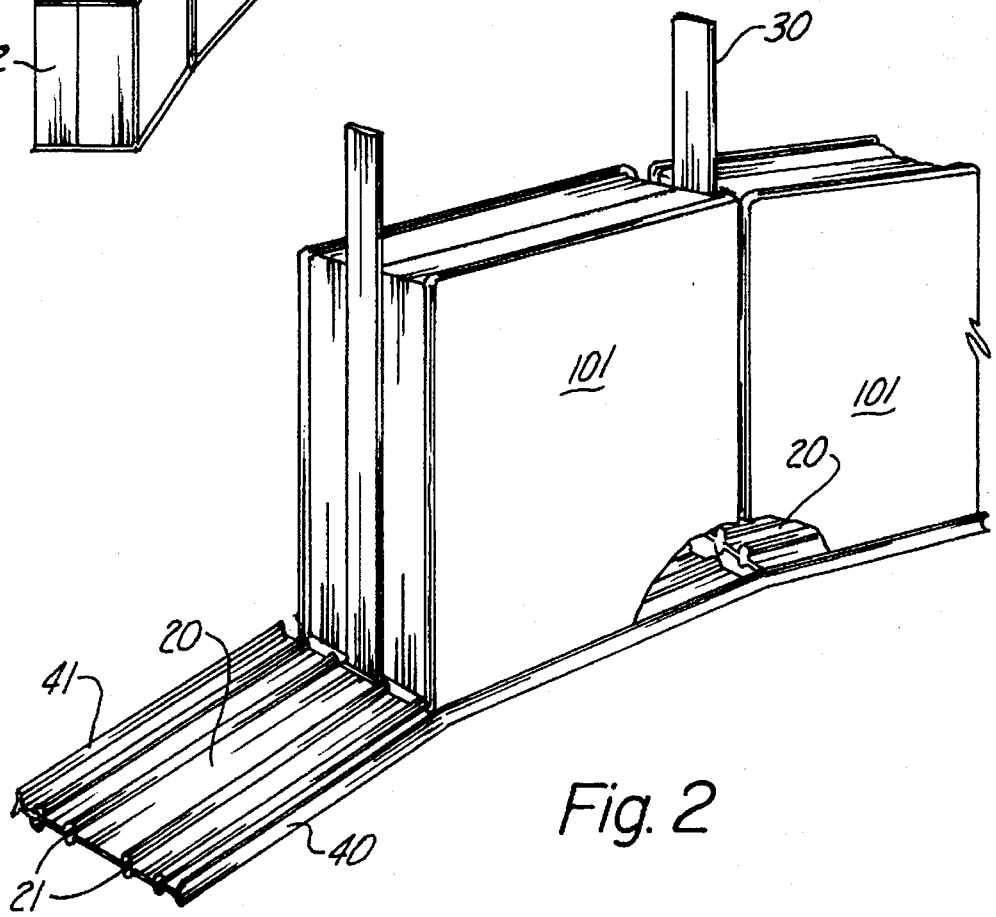
FIG. 2 is a partial perspective view of the deployment of the glass blocks on the first tier of the assembly.

As can be seen by reference to the drawings, and in particular to FIG. 1, the finished curved wall glass block assembly (100) that is created by the use of a vertical series of base tier support units which designated generally by the reference numeral (10). The curved wall glass block assembly (100) comprises in general a plurality of glass blocks (101) arranged in curved rows of vertically aligned tiers (102) (103) (104) etc. wherein each tier of blocks rests upon a tier base support unit (10).

Figure 6:
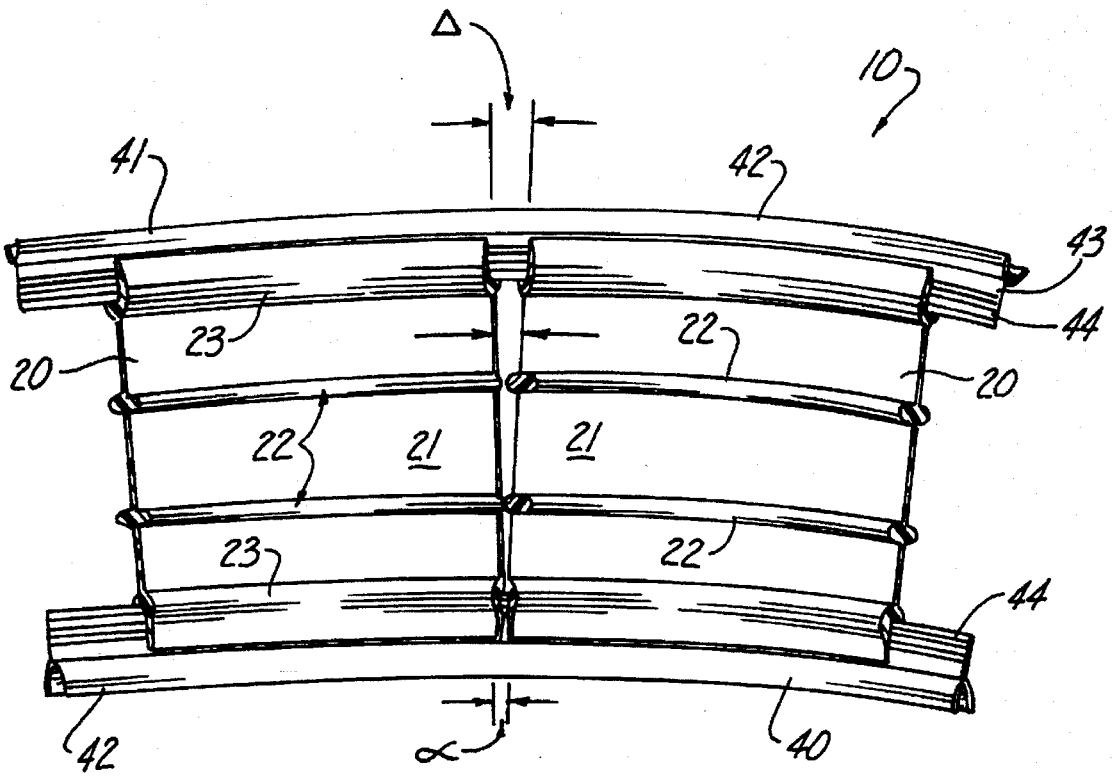
FIG. 6 is a top plan view of one section of the track assembly.

As can best be seen by reference to FIG. 6, each of the tier base support units (10) comprises a plurality of generally rigid tie members (20) connected to one or more generally flexible track members (40) (41); wherein, in the preferred embodiment of the invention the tie members (20) are connected to both of the track members (40) (41); and, in an alternate version of the invention the tie members (20) are only connected to the inside radius track member (40).

As shown in FIGS. 4 thru 7, each of the tie members (20) are identical and comprise a generally flat rectangular panel element (21) provided with a plurality of intermediate ribs (22) disposed on the top and bottom surfaces of the panel element (21) and a pair of enlarged gripping heads (23) disposed on the opposite ends of the panel element (21); wherein, the gripping heads (23) are provided with a toothed recess (24) whose purpose and function will be described presently.

Figure 4:
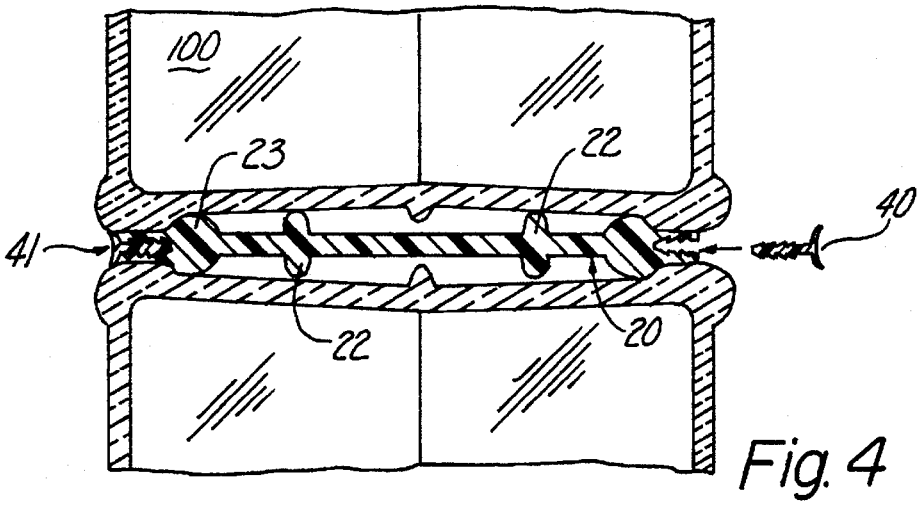
FIG. 4 is a cross-sectional detail view taken along the length of two stacked glass blocks.
Figure 7:
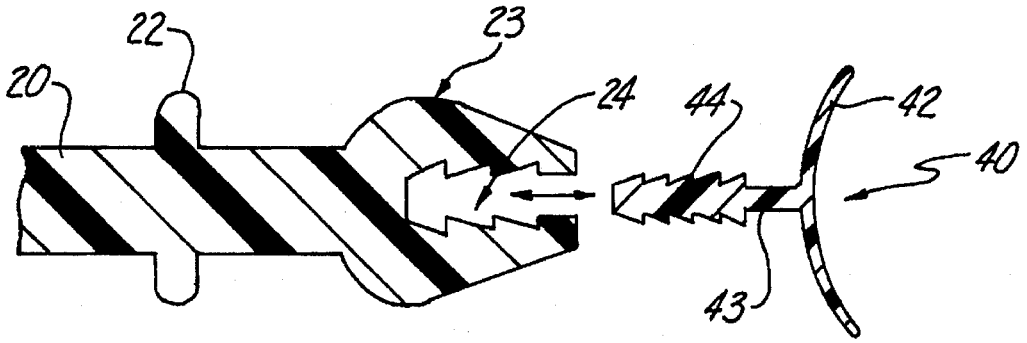
FIG. 7 is a top plan detail view of an isolated portion of the assembly.

As shown in FIGS. 4 and 7, each of the track members (40) (41) are identical and are provided with a generally T-shaped cross-sectional configuration; wherein the cross-arms (42) have an outwardly extending concave configuration which resembles a tooled grout joint, and the stem (43) is provided with a plurality of teeth (44) which are dimensioned to be lockingly engaged with the toothed recess (24) on both of the gripping heads (23) on the tie members (20).

Figure 5:
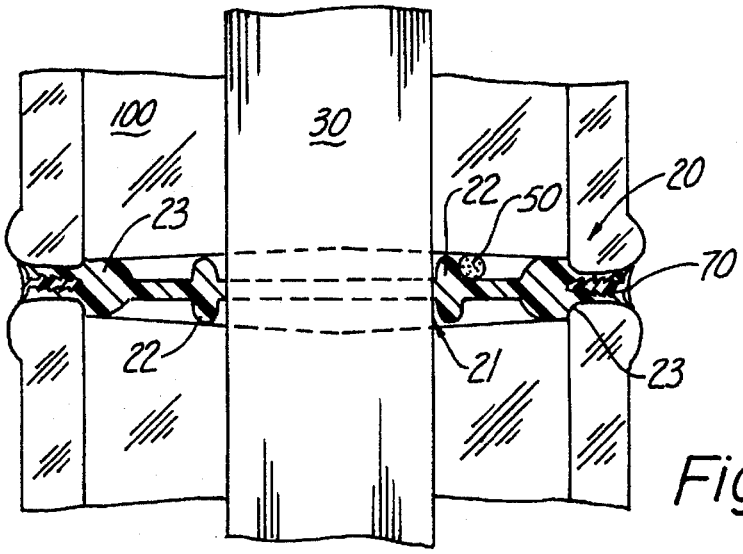
FIG. 5 is a cross-sectional view taken at the vertical juncture between rows of stacked glass blocks.

In addition, as shown in FIG. 5, the track members (40) (41) may optionally be removed after the curved wall has been assembled, and grout (70) may be introduced into the horizontal recesses created by the removal of the tracks (40) (41). The grout (70) will penetrate into the toothed recesses (24) in the tie members (20), and when the grout (70) is cured, a relatively permanent bond will be formed between the grout (70) and the individual tie members (20).

Figure 3:
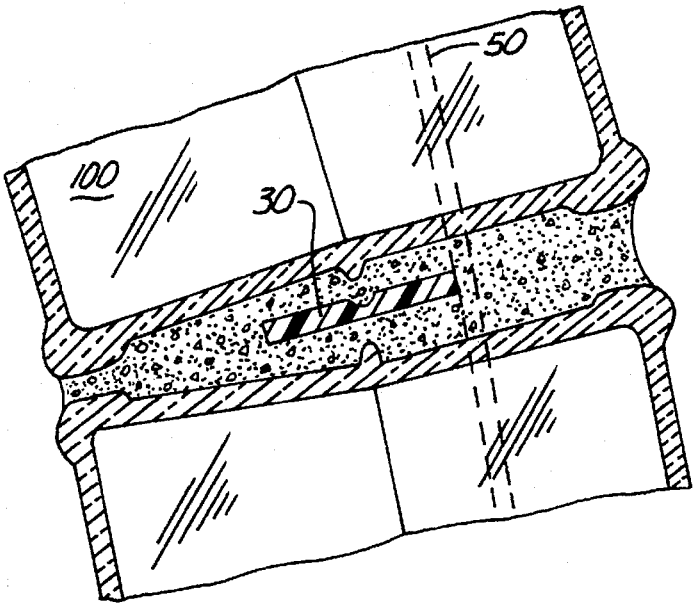
FIG. 3 is a top plan detail view of an isolated portion of the assembly.

Turning now to FIGS. 3 and 6, it can be seen that the elongated track members (40) (41) are operatively connected to one another by a plurality of tie members (20) arranged in an arcuate configuration; wherein, there is a generally small uniform spacing "α" between the inner edges of adjacent tie members (20), and, a generally enlarged uniform spacing "Δ" between the outer edges of adjacent tie members.

In the preferred embodiment of the invention illustrated in the drawings the minimum value of the spacing "α" is ⅛" and the maximum value of the spacing "Δ" is ⅝".

It should also be noted at this juncture that given the fact that most American glass blocks have a thickness of approximately 4" regardless of whether their external dimensions are 4"×8", 6"×6", 8"×8" or 12"×12"; each of the tie members (20) for any given installation are fabricated from an elongated panel element (21) which is divided into appropriately dimensioned segments; such that the individual tie members (20) are dimensioned to match the bottom dimensions of the individual glass blocks (101) which rest upon the top surface of the respective tie members (20).

The steps that are employed to fabricate a glass block wall or panel will now be described in detail. To begin with a first tier base support unit (10) is prepared having the desired curvature, as defined by the spaced vertical strips (30) and the first tier (102) of glass blocks (101) are individually placed on the individual tie members (20) intermediate the track members (40) (41). Once the first tier (102) of glass blocks (101) have been arranged on the first tier base support (10), a second tier base support unit (10') is placed on top of the first tier (102) of glass blocks (101) and the second tier (103) of glass blocks (101) are positioned over the first tier (102) of glass blocks (101). This process is repeated until the glass block wall or panel (100) has reached the desired height. As shown in FIG. 3, the vertical joints (115) are grouted with conventional joint material; and, the horizontal joints (116) on the top tier (106) of glass blocks (101) are likewise grouted with joint material. In addition, as shown in FIG. 5, a support cable (50) may be employed as an additional stiffening element along the outer race of intermediate ribs (22) to further strengthen the assembly.

It should further be noted that the grouting or buttering of the joints may also take place as each tier (102) (103) etc.

As was mentioned previously, this invention may also be practiced using only the inner track member (40); wherein, the individual panel elements (20) are arranged as a plurality of radial or quasi-radial teeth relative to the inner track member (40).

Mention should also be made about the structural similarities that exist between the configuration of the horizontal slats (20) in U.S. Pat. No. 5,010,704 and the individual panel members (20) of the present invention which are not a coincidence. As a matter of fact, the individual panel members (20) of this invention are in reality truncated segments of the horizontal slats (20) wherein the opposed sides (22) of the slats (20) have been further modified by the inclusion of the toothed recesses (24) of the present invention.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An apparatus for forming a curved wall glass block assembly formed from vertical tiers of horizontal rows of individual glass blocks each having a specific bottom dimension wherein the apparatus comprises:

a plurality of curved tier base support units dimensioned to receive each of the vertical tiers of rows of glass blocks to provide the desired contour of said glass block assembly; wherein, each of said tier base support units includes: at least one elongated curved track member; and, a plurality of generally flat rectangular tie members each having an inner end and an outer end; wherein one of said ends is operatively engaged with a portion of said at least one elongated curved track member and each tie member is further dimensioned to support the bottom one of the glass blocks.

2. The apparatus as in claim 1; wherein, each of said tier base support units comprises an inner and outer curved track member operatively connected to one another by a plurality of tie members dimensioned to support the bottom of one of said glass blocks.

3. The apparatus as in claim 1; wherein, the minimum spacing between the inner ends of the adjacent tie members has a value of "α" and the maximum spacing between the outer ends of the adjacent tie members has a value of "Δ" wherein the value of "α" is less than the value of "Δ".

4. The apparatus as in claim 1; wherein, said at least one curved track member has a generally T-shaped cross-sectional configuration wherein the cross-arms are provided with an outwardly extending concave configuration and the stem is provided with means for operatively engaging the inner ends of the plurality of tie members.

5. The apparatus as in claim 2; wherein, each end of the plurality of tie members is provided with an enlarged gripping head dimensioned to receive a portion of one of the track members.

6. The apparatus as in claim 5; wherein, each of the track members has a generally T-shaped cross-sectional configuration wherein the stem is dimensioned to be received within the gripping heads on either end of the tie members.

7. The apparatus as in claim 6; wherein, each of the cross-arms on the T-shaped track members are provided with an outwardly extending concave configuration.

8. The apparatus as in claim 7; wherein, each gripping head is provided with an enlarged toothed recess and the stems of the track members are provided with a plurality of teeth dimensioned to be received in said toothed recess.

9. The apparatus as in claim 1; wherein, each of said tie members comprises a generally rectangular plate element provided with a plurality of raised ribs on opposite sides of the plate element.

10. The apparatus as in claim 2; wherein, each of said tie members comprises a generally rectangular plate element provided with a plurality of ribs on opposite sides of the plate element.

11. A method of fabricating a curved wall glass block assembly from vertical tiers of horizontal rows glass blocks using a plurality of tier base support units wherein each unit includes at least one curved track member having a plurality of radially arrayed generally flat rectangular tie members projecting outwardly therefrom, wherein each generally rectangular tie member is dimensioned to support the bottom surface of an individual glass block comprising the steps of:

a) placing a first tier base support unit on a horizontal surface in a desired arcuate configuration;

b) arranging a first horizontal row of individual glass blocks into a first tier wherein each of the blocks of said first tier rests on one of the tie members and has one side which abuts against a portion of said at least one curved track member of said first tier base support;

c) placing a second tier base support unit on top of said first horizontal row of individual glass blocks;

d) arranging a second horizontal row of individual glass blocks into a second tier on top of said second tier base support unit wherein each of the blocks of said second tier rests on one of the tie members and has one side which abuts against a portion of said at least one curved track member of said second tier base support;

e) placing succeeding tier base support units on top of the preceding horizontal row of individual glass blocks forming said preceding vertical tier; and, f) arranging succeeding horizontal rows of individual glass blocks on top of the tie members which rest upon the preceding horizontal row of individual glass blocks.

12. The method as in claim 11 further comprising the step of g) grouting the joints in the tiers of horizontal rows of individual glass blocks.

13. A method of fabricating a curved wall glass block assembly from vertical tiers of horizontal rows of glass blocks using a plurality of tier base support units wherein each unit includes an inner and an outer curved track member operatively connected together by a plurality of generally flat rectangular tie members; wherein, each generally rectangular tie member is dimensioned to support the bottom surface of an individual glass block comprising the steps of:

a) placing a first tier base support unit on a horizontal surface in a desired arcuate configuration;

b) arranging a first horizontal row of individual glass blocks into a first tier wherein each of the blocks of said first tier rests on one of the tie members of said first tier base support;

c) placing succeeding tier base support units on top of the preceding horizontal row of individual glass blocks forming said preceding vertical tier; and, d) arranging succeeding horizontal rows of individual glass blocks on top of the tie members which rest upon the preceding horizontal row of individual glass blocks.

14. The method as in claim 13 further comprising the step of e) grouting the joints in the tiers of horizontal rows of individual glass blocks.

15. The method as in claim 14, further including the step of:

f) providing structural stiffening elements at spaced intervals in said curved wall glass block assembly.

16. The method as in claim 15; wherein, the stiffening elements are deployed at spaced horizontal intervals.

17. The method as in claim 15; wherein, the stiffening elements are deployed at spaced vertical intervals.

18. The method as in claim 15; wherein, the stiffening elements are disposed at spaced horizontal and vertical intervals.

* * * * *